United States Patent [19]

Kosugi et al.

[11] Patent Number: 4,978,111

[45] Date of Patent: Dec. 18, 1990

[54] RECORDING SHEET STACKING APPARATUS IN IMAGE RECORDING SYSTEM

[75] Inventors: Akira Kosugi; Kouichi Hanada, both of Hachioji, Japan

[73] Assignee: Konica Corporation, Tokyo, Japan

[21] Appl. No.: 234,025

[22] Filed: Aug. 18, 1988

[30] Foreign Application Priority Data

Aug. 25, 1987 [JP] Japan ..... 62-211690

[51] Int. Cl.[5] ..... B65H 5/22; G03G 21/00

[52] U.S. Cl. ..... 271/3.1; 271/110; 271/117; 271/227; 355/319

[58] Field of Search ..... 355/24, 318, 319, 320; 271/3.1, 110, 117, 227, 245, 258

[56] References Cited

U.S. PATENT DOCUMENTS 4,671,644 6/1987 Sumida et al. ..... 355/319

4,697,911 10/1987 Kajita et al. ..... 355/319

*Primary Examiner*—Fred L. Braun

*Attorney, Agent, or Firm*—Jordan B. Bierman

[57] ABSTRACT

A sheet stacking mechanism for use in apparatuses wherein an image is recorded on both sides of a recording sheet, including a bumper roller which is capable of retractably shifting to a downward position to be in pressure contact with the recording sheets on an intermediate tray and transport the recording sheets to a stopper where the leading edges thereof are aligned and, a sensor and control device for controlling the position of the roller so that the roller is shifted downward onto the recording sheet to be aligned when the sheets reach the tray, and raised out of contact with the sheets when the leading edges reach the stopper.

1 Claim, 16 Drawing Sheets

(A) MODE (B) MODE (C) MODE

RECORDING SHEET STACKING APPARATUS IN IMAGE RECORDING SYSTEM

FIELD OF THE INVENTION

The present invention relates to a stacking apparatus for sheet-like recording paper, where the similar apparatus is used on an image recording system such as an electrophotographic copying apparatus or a laser printer, or the like, and, the invention more specifically relates to a recording sheet stacking apparatus on an image recording system that is capable of recording images on recording sheets in either composite copying mode or double-side copy mode.

BACKGROUND OF THE INVENTION

Hitherto, various techniques have been proposed for incorporation into automatic double-side copying apparatuses that are used on an electrophotographic copying apparatus or on a laser printer or the like, and capable of subjecting recording sheet to each of one-side copying and double-side copying. Conventional automatic double-side recording apparatuses, in their image processing portion, record an image on one face of a recording sheet, thereby the recording sheet is temporarily stocked in an intermediate portion, and then, the sheet is refed into the image processing portion. Such automatic sheet recirculating/conveying apparatuses are disclosed in Japanese Patent Publication Open to Public Inspection (hereinafter referred to as Japanese Patent O.P.I. Publication) Nos. 82247/1984, 114227/1984, and 2241/1985.

There has been developed a technique in regard with an image recording apparatus provided with image forming means that is capable of performing, not only the above-mentioned double-side copy mode where images are recorded on both faces of recording sheets, but a composite copy mode where images of plurality of document sheets are commonly copied onto one face of each recording sheet. One such a technique is disclosed, for example, in Japanese Patent O.P.I. Publication No. 123474/1987.

According to this patent, the technique is as follows: in the case of a composite copy mode for a single recording sheet, the recording sheet having been subjected to paper feeding, image-transferring, separating, and image-fixing is transported to a recirculating path for composite copying, and then, refed into an image forming portion based on a composite copy instruction entered from an operation part, thereby on the same face of the recording sheet is formed another copy image.

In the case of a double-side copy mode for one recording sheet, a recording sheet undergone one-side copying is temporarily delivered outside a copying apparatus by delivery rollers, and turned over, then refed into the image forming portion via the above-mentioned recirculating path, thereby a copy image is formed on the other face of the recording sheet.

In the case of a composite copy mode for a plurality of recording sheets, individual recording sheets undergone fixing are temporarily delivered outside, by the delivery rollers, outside a copying apparatus as controlled like in the case of the above-mentioned double-side copying operation for a single recording sheet, and then, by reverse rotation of the delivery rollers, the recording sheets are diverted from a certain point on the recirculating path, thereby these sheets are stored in the intermediate stacker. This sequence is maintained until all the sheets independently bearing a copied image on one face have been stored in the intermediate stacker. Then, based on a new copy instruction, the recording sheets are individually transported from the intermediate stacker, conveyed through the recirculating path, and fed into the image forming portion, thereby the second image is copied onto the individual recording sheets.

In the case of a double-side copy mode for a plurality of recording sheets, individual recording sheets are, as controlled like in the case of the above-mentioned composite copy mode for a single sheet, transported from a fixing unit to a certain point in the recirculating path, where diverted and then stored in the intermediate stacker. The operation onwards is identical with that of the above-mentioned composite copy mode.

As described above, a conventional recording sheet conveyance apparatus used on an image recording system, and that is capable of performing automatic double-side/composite copy modes has a complicated recording sheet conveyance path for double-side and composite recording modes, and, therefore, such an apparatus is disadvantageous in that such a path incurs complicated constitution, operation, and controlling.

In a double-side copy mode or composite copy mode, and when recording sheets of various sizes independently bearing an image on one face are temporarily stored in an intermediate stacker, some of the leading edges fail to reach the stopper face of the intermediate stacker because of different lengths of the sheets, and, the recording sheets are therefore misaligned with each other. As a result, there can occur a problem of misfed sheet, or misoriented recorded image, or the like when the recording sheets are refed to an image forming portion and subjected to double-side or composite copy operation.

SUMMARY OF THE INVENTION

The present invention is intended to eliminate the problems with the above-mentioned recording sheet conveyance apparatus, and the object of the invention is to provide a recording sheet conveyance apparatus that is capable, in the course of double-side or composite copying operation, of correctly storing recording sheets of different sizes respectively bearing an image on one face in an intermediate stacker, and capable of positively refeeding recording sheets from the intermediate stacker without any irregularities.

The recording sheet conveyance apparatus of the invention capable of achieving the above-mentioned object is a recording sheet conveyance apparatus that is capable of subjecting recording sheets to composite or double-side copying by recording, by means of an image forming portion, an image on one face of individual sheets that have been transported from a paper feeding portion, and by transporting the sheets to the recording sheets to a stacker in the recording sheet conveyance apparatus and accumulating them therein, and then, by refeeding these recording sheets to the image forming portion, wherein the stacker in the recording sheet conveyance apparatus is movably provided with a roller that rotates as pressed onto a recording sheet being transported and that is capable of transporting a recording sheet to the stopper face, and wherein the duration where the roller is pressed onto a recording sheet is varied depending on the size of a recording sheet being transported.

DETAILED DESCRIPTION OF THE PREFERRED EMBODIMENTS

The preferred embodiments according to the invention are hereunder described in detail by referring to the attached drawings.

Figure 1:
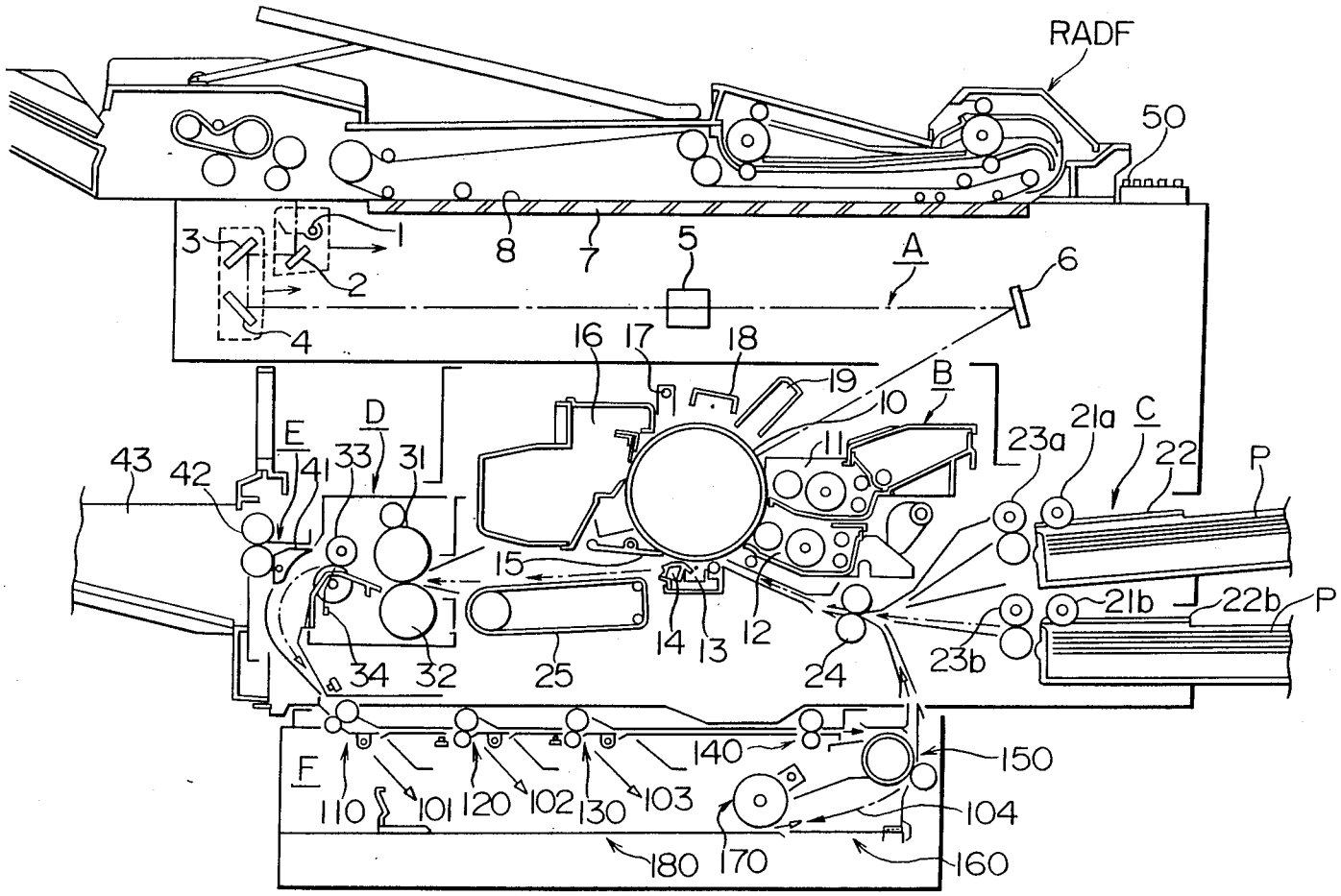
FIG. 1 schematically illustrates the outline of an in image recording system according to the invention.

FIG. 1 is a schematic diagram of an image recording apparatus that is provided with a recording sheet stacking apparatus according to the invention.

In this figure, A represents a scanning exposure system that comprises a first scanning unit being driven for scanning in the arrow direction and comprising a light source 1 and a first mirror 2; and that also comprises a second scanning unit comprising a second mirror 3 and a third mirror 4 and being driven for scanning in the arrow direction. The scanning exposure system A also comprises a lens 5, and a fixed, fourth mirror 6. An optical image of a document sheet 8 on a platen 7 is directed to and focused on the photoconductive surface of a photoreceptor drum 10 by the above-mentioned scanning system. The area, on the photoreceptor drum 10, which is irradiated with the scanning system is electrified in advance by an electrification electrode 18, thereby an electrostatic latent image of a document is formed on the same area based on the optical image directed thereto.

B represents an image forming portion being constituted based essentially on the photoreceptor drum 10. Numerals 11 and 12 represents developing units respectively containing toners of different colors (for example, red, and black), wherein a specific developing unit containing a toner of a specific color is selectively allowed to come in contact with the photoreceptor drum 10. That is, either the first developing unit 11 or the second developing unit 12 is pressed onto the photoreceptor drum 10 based on the selection instruction fed from an operation panel 50. According to this embodiment of the invention, the first developing unit 11 contains a color toner, and the second developing unit 12 contains a black toner.

Either the developing unit 11 or 12 develops the electrostatic latent image, thereby the latent image is converted into a toner image of a specific color.

Around the photoreceptor drum 10, in addition, are disposed a transfer electrode 13, a separation electrode 14, a separation claw 15, a cleaning device 16, a pre-electrification exposure lamp 17, an electrification electrode 18, a blank exposure lamp 19 (LED array), and the like. The LED array 19 eliminates an unnecessary electrical potential that is present on an area other than an image area. The LED array 19 comprises a multiplicity of LEDs being arrayed in one entity, and is capable of erasing any arbitrary area in an image, and, therefore, enables not only masking or trimming described later but also multiple composite copying based on the masking/trimming features.

Figure 2:
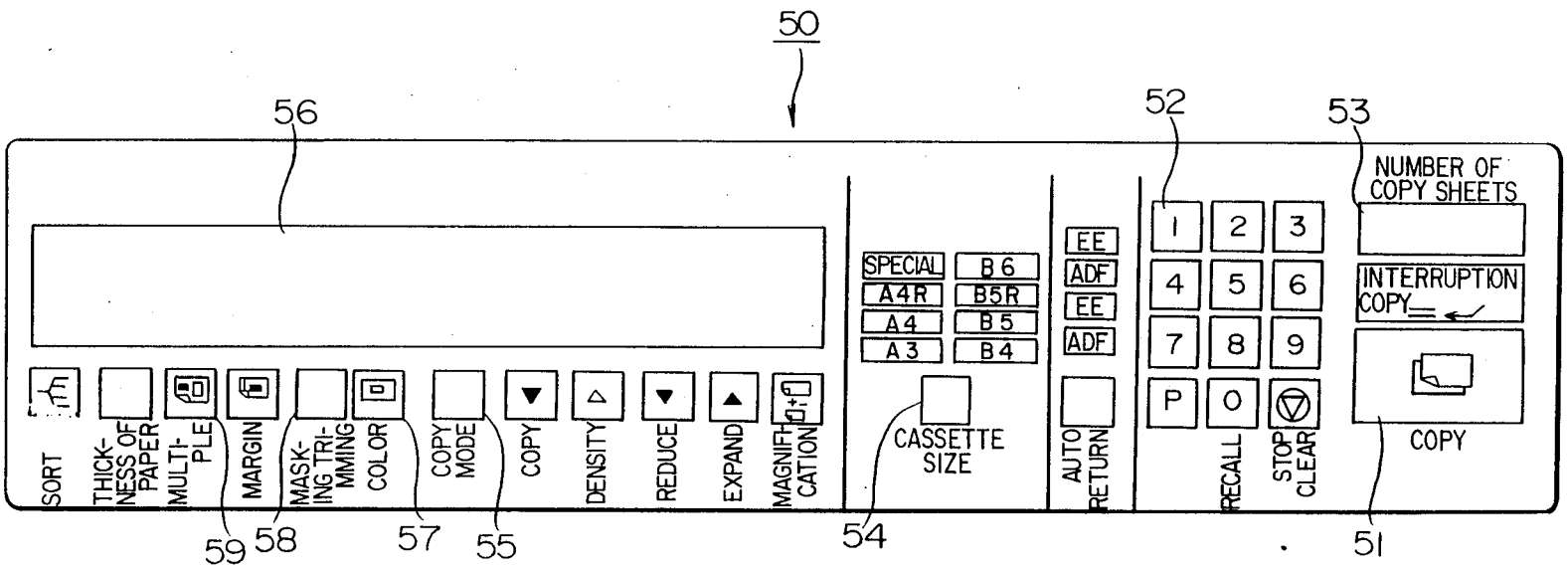
FIG. 2 is an external view of an operation panel.

FIG. 2 is an external view of the operation panel 50, wherein the above-mentioned masking or trimming is performed as selected with a copy mode selection key 55 on the operation panel 50.

Recording sheets (transfer paper) P supplied by a paper sending roller 21*a* (or 21*b*) from a paper cassette 22*a* (or 22*b*) in a paper feed unit C are separated by paper feed rollers 23*a* (or 23*b*) that have a built-in torque limiter, thereby a single recording sheet P alone is transported and reaches timing rollers 24, and temporarily waits for further activity.

Then, the timing rollers 24 is energized based on timing where the leading edge of a positive image area, on the photoreceptor drum 10, of a document can be synchronously aligned with the leading edge of a recording sheet P, thereby the recording sheet P is transported to the photoreceptor drum 10. The recording sheet P is tightly positioned on the photoreceptor drum 10 as attracted by electrical discharge of the transfer electrode 13, and then, under this condition, a toner image on the photoconductive drum 10 is transferred onto the recording sheet P.

Next, by the separation electrode 14 and the separation claw 15, the recording sheet P is separated from the surface of the photoreceptor drum 10. Then, by the cleaning device 16, the unused toner present on the photoconductive drum 10 is collected for re-use, and the potential on the surface of the photoreceptor drum 10 is uniformly neutralized by the pre-electrification exposure lamp 17, whereby next copy cycle is performed.

The recording sheet P separated from the photoreceptor drum 10 is transported by transporting means such as a transportation belt 25 or the like, and while traveling along a fixing unit D, the sheet P is heated for fixation by a heating roller 31 and a presser roller 32. The recording sheet P undergone fixing is delivered outside the copying apparatus by delivery rollers 33. Numeral 34 represents a paper delivery sensor.

A recording sheet P delivered from the fixing unit D travels, in the case of ordinary single side copy mode, along the upper face of a movable deflector plate (flapper) 41 in a delivery/reversing portion E, and is delivered by delivery rollers 42 onto a tray 43 or unshown sorter disposed outside the copying apparatus.

Beneath the above-described image forming portion B, fixing unit D, and delivery/reversing portion E, is disposed a recording sheet conveyance apparatus F. At the same time, on the platen 8 is disposed an automatic document feeder RADF.

The copy modes are hereunder described in detail.

FIG. 2 is the external view of the operation panel 50. In this drawing, numeral 51 represents a copy key; 52, a ten-key pad, with the respective keys for entering a number of copy sheets; 53, a display portion for displaying a number of copy sheets; 54, a sheet size selection key with which the paper cassette 22*a* or 22*b* is selected; 55, a selection key for selecting a copy mode; and 56, a wide screen liquid crystal display portion.

Figure 4:
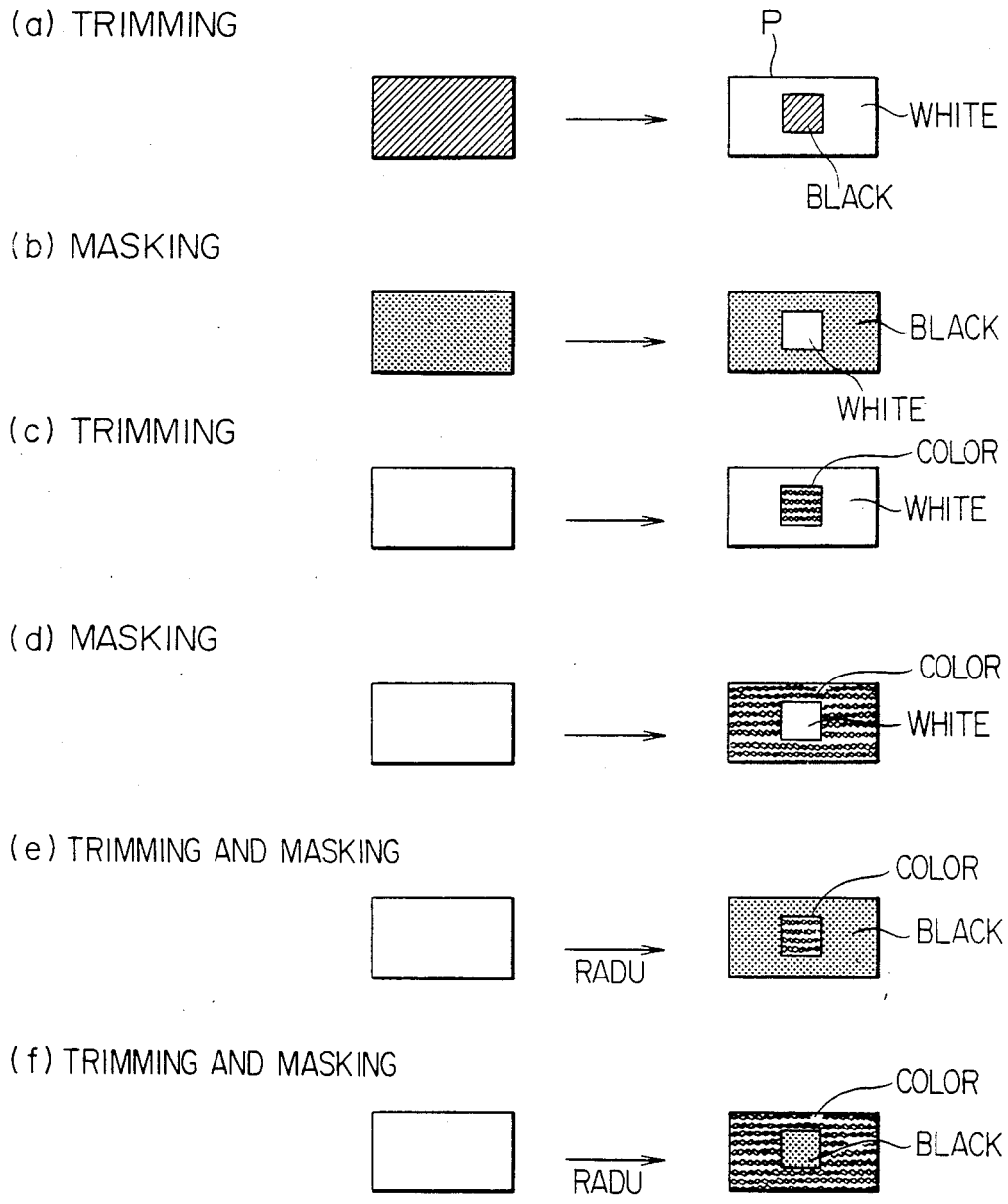
FIG. 4 illustrates schematics for explaining trimming and masking.

The correlation between a document and a copy mode based on manipulation of the above-mentioned copy mode selection key is hereunder described by referring to explanatory diagrams for four mode in FIG. 4. In the following description, RADF means an automatic double-sided document feed mode; ADU, a conveyance mode for subjecting a recording sheet to double-side copying; and RADU, a conveyance mode for subjecting a recording sheet to one-side composite copying.

Mode 1 one-sided document → double-sided copy

Figure 3:
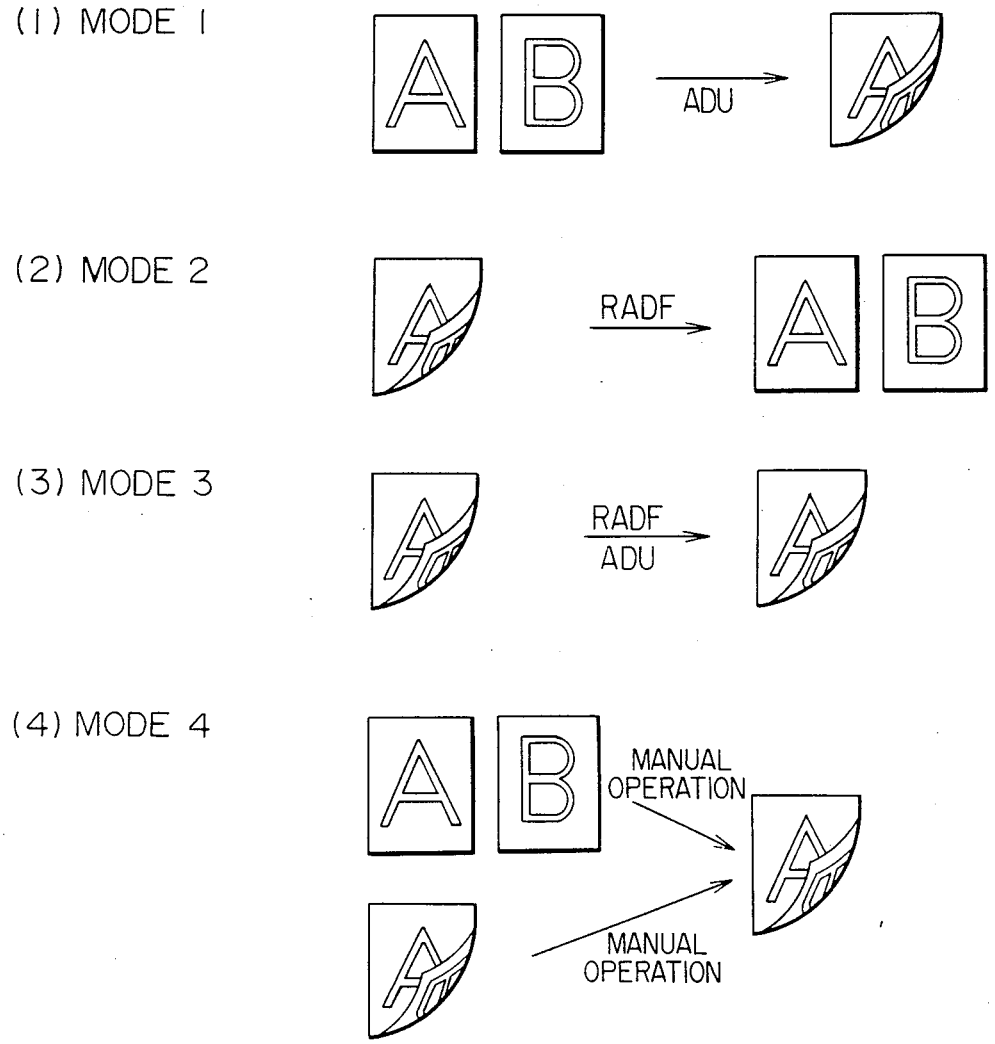
FIG. 3 illustrates schematics of performing double-side copying.

First, pressing the copy mode selection key 55 starts the ADU mode, whereby as shown in FIG. 3-(1), a double-sided copy is obtained based on two sheets of one-sided document. After a document sheet A is placed on the platen 8, and a number of copy sheets is entered, and then, the copy key 51 is pressed, thereby an image is formed on one face of the respective recording sheets P. Next, a document sheet B is placed on the platen 8, and the copy key 51 is pressed, thereby an image is formed on the other face of the respective recording sheets P.

Mode 2 double-sided document → one-sided copy

Pressing again the copy mode selection key 55 activates the RADF mode, whereby as shown in FIG. 3-(2), two sheets of one-sided copy are obtained based on one double-sided document sheet. After a double-sided document sheet A is loaded into the RADF unit, the copy key 51 is pressed, thereby a copy A is obtained based on the face A of the document sheet, and then, the document sheet is turned over in the RADF unit, thereby a copy B is obtained based on the face B of the document sheet.

Mode 3 double-sided document → double-sided copy

Pressing again the copy mode selection key 55 again activates both the RADF mode and an ADU mode, whereby as shown in FIG. 3-(3), a mode for forming double-side copy based on a double-sided document starts. After a double-sided document sheet is loaded in the RADF unit, the copy key 51 is pressed, thereby a copy A is formed on one face of a recording sheet based on the face A of the document, and then, the document sheet is turned over in the RADF unit, and, at the same time, the recording sheet P is turned over in the ADU unit, thereby the image on the face B of the document sheet is recorded on the other face of the recording sheet P to form a copy B, thus double-side copy is automatically obtained.

Mode 4 manual operation mode

This mode starts when the copy mode selection key 55 is pressed once more, and is for manually obtaining a double-sided copy, wherein this mode does not use the above-mentioned RADF and ADU. A one-sided document, or the face A of a double-sided document sheet is placed on platen 8, and the copy key 51 is pressed to form a copy A on a recording sheet P, which is delivered onto a tray. Then, the face B of the document sheet is placed on the platen 8, and, at the same time, the recording sheet P on the tray is loaded into the paper cassette 22*a* or 22*b*, and the copy key 51 is pressed again, to form a copy image B on the rear face of the recording sheet P.

Numeral 57 represents a color copy selection key for selectively performing either color copying (for example, for a red image) or black copying.

Numeral 58 represents a masking/trimming selection key that is capable of selecting any of the modes in FIG. 4-(*a*) through (*f*). The masking or trimming is performed by activating a part of the previously mentioned LED array 19 based on an area designated with, for example, a light pen.

(a) mode a mode for assigning black to a designated area

As shown in FIG. 4-(*a*), a designated area on a document is copied in black. A document sheet is set on the platen, and (a) mode is designated with the selection key 58 to designate a relevant area, and then, the copy key 51 is pressed, thereby the area is reproduced in black on a recording sheet P.

(b) mode a mode for assigning black to an area other than that designated

As shown in FIG. 4-(*b*), an area other than that designated on a document is copied in black. A document sheet is set on the platen, and (a) mode is designated with the selection key 58 to designate a relevant area, and then, the copy key 51 is pressed, thereby the area other than that designated is reproduced in black on a recording sheet P.

(c) mode a mode for assigning a color to a designated area

As shown in FIG. 4-(*c*), a designated area on a document is copied in a specific color. A document sheet is set on the platen, and (c) mode is designated with the selection key 58 to designate a relevant area, and then, the copy key 51 is pressed, thereby the area is reproduced in a specific color on a recording sheet P.

(d) mode a mode for assigning a color to an area other than that designated

As shown in FIG. 4-(*d*), an area other than that designated on a document is copied in black. A document sheet is set on the platen, and (d) mode is designated with the selection key 58 to designate a relevant area, and then, the copy key 51 is pressed, the area other than that designated is reproduced in a specific color on a recording sheet P.

(e) mode a mode for assigning a color to a designated area, and black to an area other than that designated As shown in FIG. 4-(*e*), a designated area on a document is copied in a specific color, while an area other than that designated is copied in black. A document sheet is set on the platen, and (e) mode is designated with the selection key 58 to designate a relevant area, and then, the copy key 51 is pressed, thereby the designated area is reproduced in a specific color on a recording sheet P. Next, the RADU mode recirculates the recording sheet P, thereby an image of the area other than that designated is formed in black on the recording sheet P.

Incidentally, the area other than that designated can be copied at first.

(f) mode a mode for assigning black to a designated area, and a color to an area other than that designated As shown in FIG. 4-(*f*), a designated area on a document is copied in black, while an area other than that designated is copied in a specific color. A document sheet is set on the platen, and (f) mode is designated with the selection key 58 to designate a relevant area, and then, the copy key 51 is pressed, thereby the designated area is reproduced in black on a recording sheet P. Next, the RADU mode recirculates the recording sheet P, thereby an image of the area other than that designated is formed in a specific color on the recording sheet P. This mode is "reverse" to (e) mode.

Figure 5:
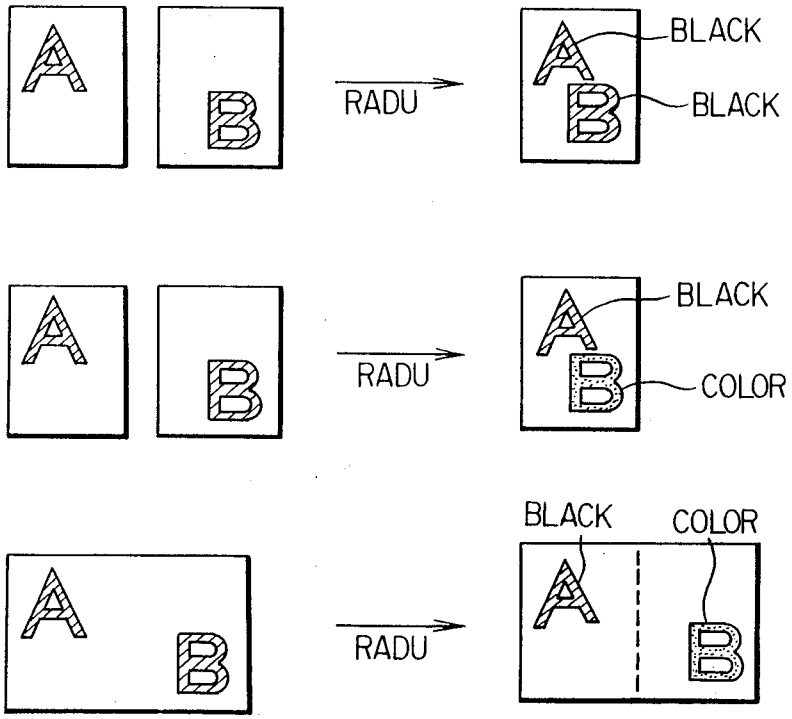
FIG. 5 illustrates schematics for explaining composite copying.

Next, the operation in composite mode that is started by a multiple selection key 59 on the operation panel 50 is hereunder described by referring to FIG. 5.

(A) mode: one-sided document → monochromatic composite copy

As shown in FIG. 5-(A), a composite copy is obtained based on two document sheets, wherein using the multiple selection key 59, (A) mode is selected, and then, a document A is set on the platen, and the copy key 51 is pressed, thereby an image is formed on one face of a recording sheet P. Next, a document B is set on the platen, and when the copy key 51 is re-pressed, the RADU mode recirculates the recording sheet P, thereby an additional image is formed on the same face of the recording sheet P where the image of the document A is already present.

(B) mode: one-sided document—two-color composite copy

As shown in FIG. 5-(B), a two-color composite copy is obtained based on two one-sided document sheets, wherein using the multiple selection key 59, (B) mode is selected, and then, a document A is set on the platen, and the copy key 51 is pressed, thereby a black image is formed on one face of a recording sheet P. Next, a document B is set on the platen, and when the copy key 51 is re-pressed, the RADU mode recirculates the recording sheet P, thereby a color image is additionally formed on the same face of the recording sheet P where the image of the document A is already present.

(C) mode: one-sided document → two-color composite copy

As shown in FIG. 5-(C), a two-color composite copy is obtained based on a single document sheet, wherein using the multiple selection key 59, (C) mode is selected, and then, a document sheet is set on the platen, and the copy key 51 is pressed, thereby a black image is formed on a specific area in one face of a recording sheet P. In this course, the electrical potential on an image B area on the document is neutralized by the LED array 19, and, therefore, this image area is not copied. Next, when the copy key 51 is re-pressed, the RADU mode recirculates the recording sheet P, thereby a color image is additionally formed in an area, other than that already bearing the image of the document A, on the same face of the recording sheet P. Additionally, in this course, the electrical potential on the image area A on the same document is neutralized by the LED array 19, and, therefore, this image area is not copied.

Beneath the image recording system is detachablly installed, as shown in FIG. 1, an automatic recording sheet conveyance apparatus F that recirculates or reversingly transports a recording sheet P. The recording sheet conveyance apparatus F is provided with two conveyance modes; ADU mode where a recording sheet is reversingly conveyed in order to allow the double-side copying, as mentioned above, with an image recorded on the rear face of the sheet; and RADU mode where an additional image is recorded on the face of recording sheet where another copied image is already present, in order to enable masking/trimming, and composite copying.

Figure 6:
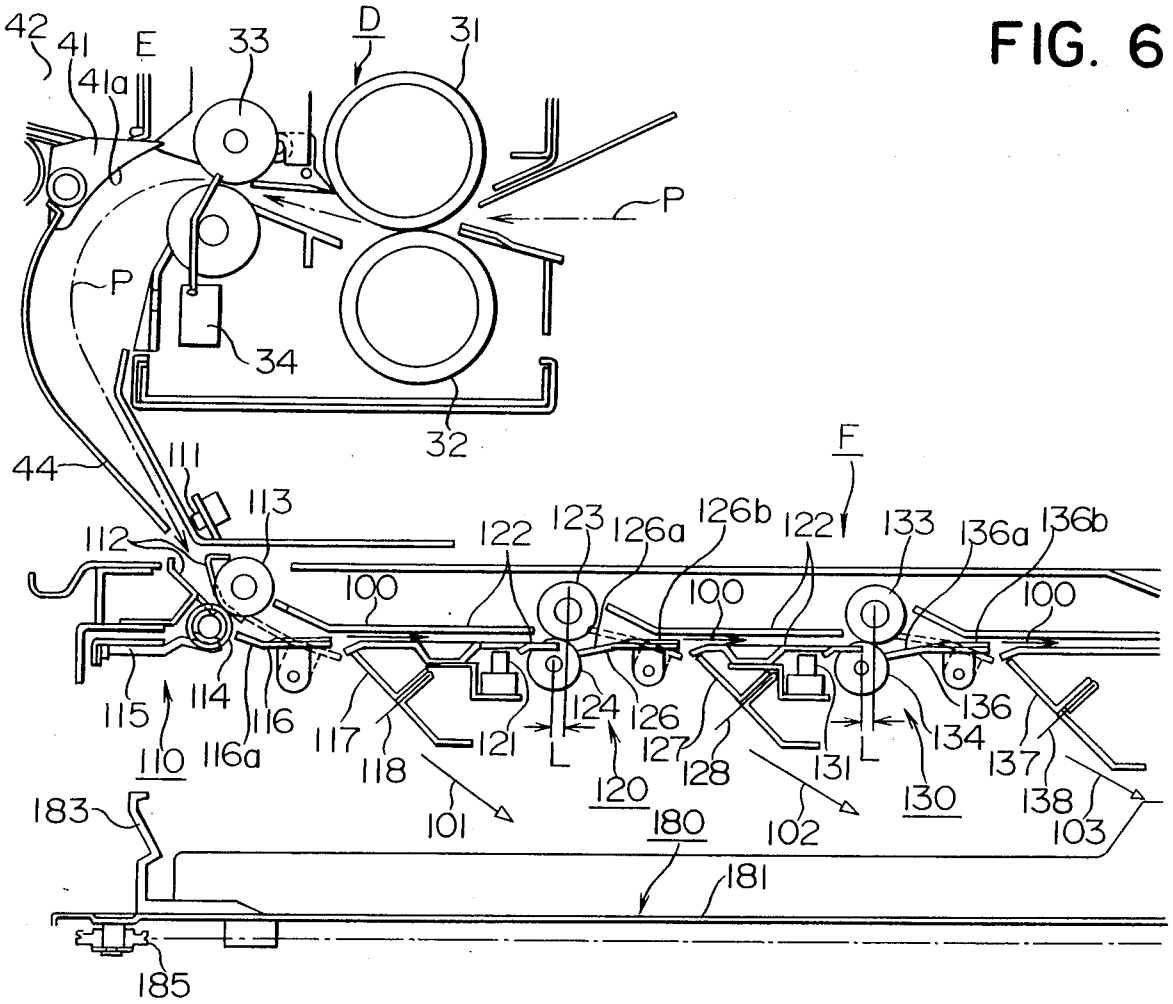
FIGS. 6 and 9 are cross-sections of a recording sheet conveyance apparatus.
Figure 10:
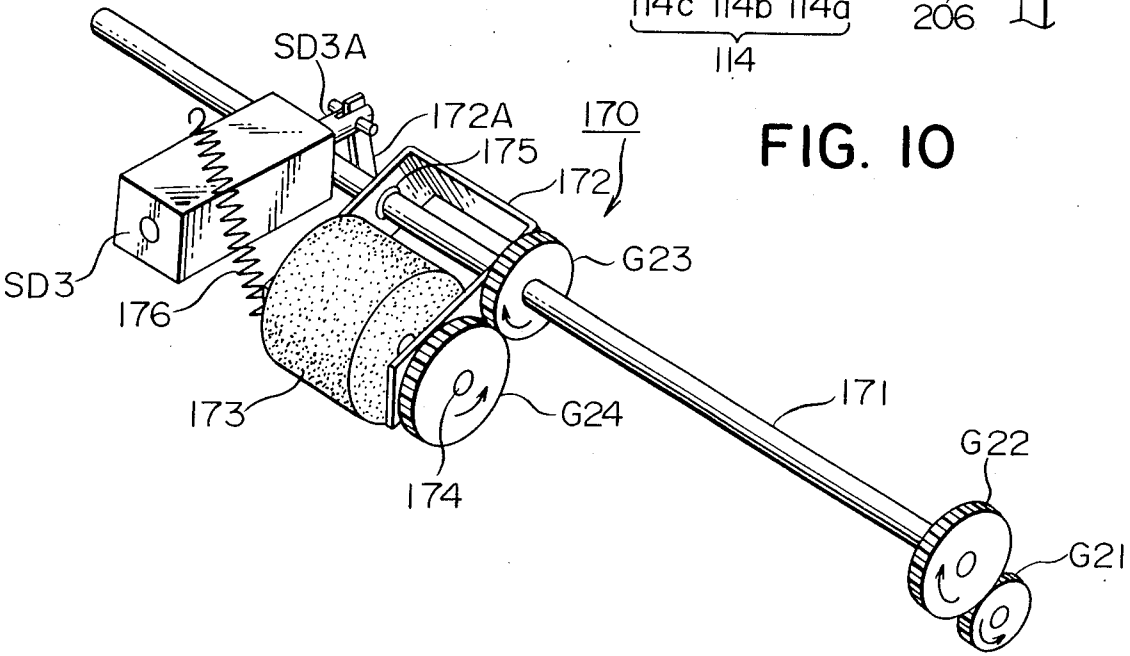

The constitution of the recording sheet conveyance apparatus is first described by referring to FIGS. 1, 6, and 10.

Figure 7:
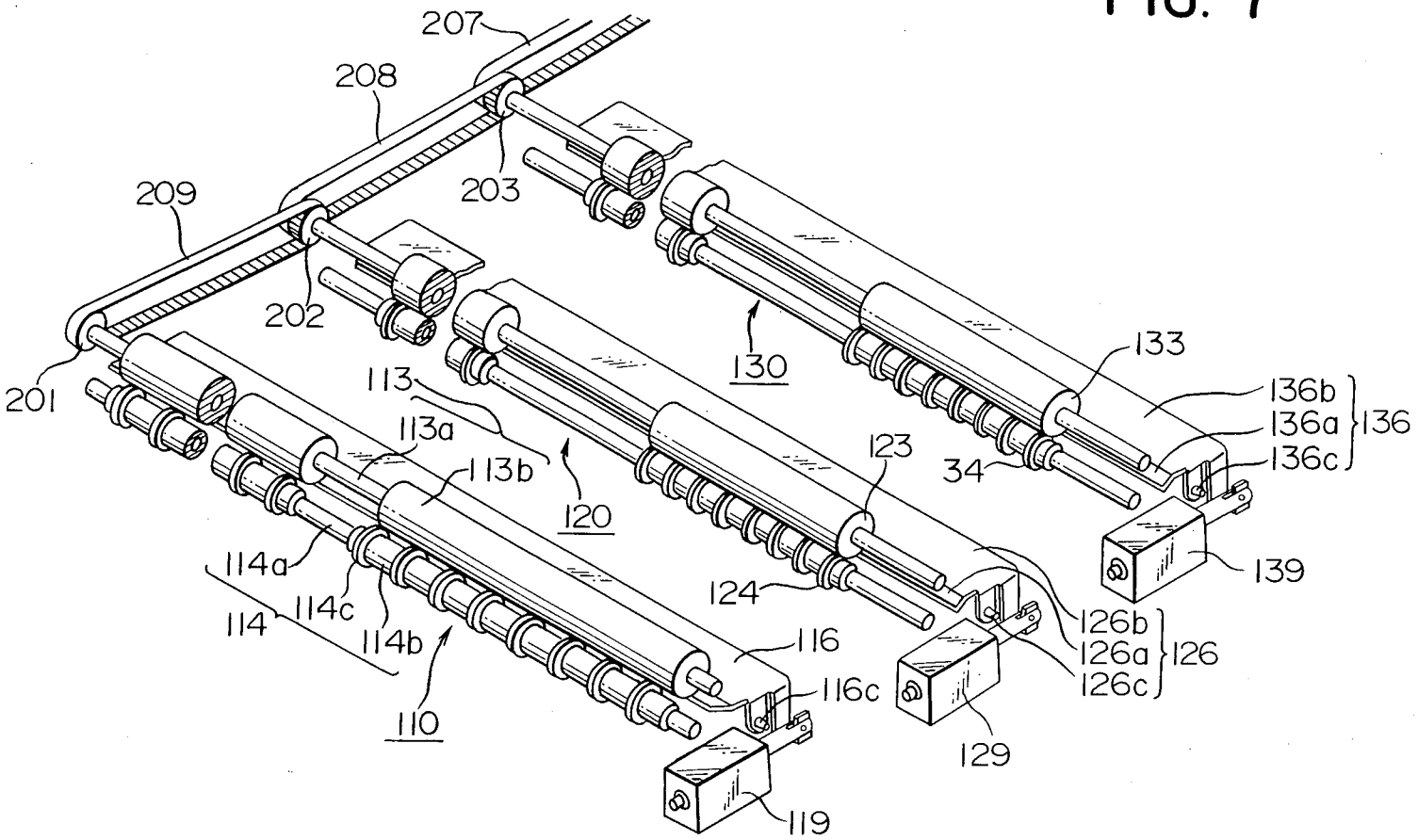
FIGS. 7, 10, and 11 are perspective diagrams of components on the recording sheet conveyance apparatus.

FIG. 6 is a cross section of the principal area of a recording sheet conveyance path starting at the fixing unit D, via the delivery/reversing portion E, and reaching a portion of the recording sheet conveyance apparatus F. FIG. 7 is a partial perspective view of the principal area of the conveyance path.

As shown in these drawings, in the case of double side copying or composite copying, a deflector plate (flapper) 41 has been shifted to a position shown in FIG. 6 by the operation of an unshown solenoid, whereby the leading edge of a recording sheet P that has undergone paper-feeding, image-transferring, paper-separating, and image-fixing pass between delivery rollers 33 and is diverted downward in a cursive trajectory along the curved surface 41*a* below the deflector plate 41, thereby the leading edge enters the inlet of the recording sheet conveyance apparatus F as guided by a fixed guide plate 44.

A first conveyance switching portion 110 in the vicinity of the inlet comprises a photosensor 111 that detects the passage of the leading or trailing edge of a recording sheet P; inlet guide plate 112; driving roller 113; follower roller 114 that rotates as pressed onto the driving roller 113; pressing member 115 that presses the follower roller 114 onto the driving roller 113; first gate plate 116 that is swingably actuated; oblique guide plate 117 along which a recording sheet P is allowed to fall obliquely; neutralizing brush 118; and the like.

A recording sheet P introduced from the delivery/reversing portion E into the first conveyance switching portion is further transported therefrom to one of two directions. If a guide plane 116*a* on the first gate plate 116 is in the horizontal position, a recording sheet P passes along the upper face of the guide plane 116*a* toward a horizontal path 100 shown by an arrow facing the horizontal right direction. If the first gate plate 116 has been swung on an axle 116*c* as actuated by a solenoid 119 (refer to FIG. 7) and is in the position shown by broken lines as in FIG. 6, the guide plane is positioned obliquely, thereby a recording sheet P falls along the lower face of the guide plane 116*a* and is transported toward a downward path 101 indicated by an arrow.

Toward the right of the first conveyance switching portion 110 (refer to FIG. 6), and in the downstream side of the horizontal path 100 is disposed a second conveyance switching portion 120. The second conveyance switching portion 120 has constitution approximately same as that of the first conveyance switching portion, and comprises a photosensor 121; upper and lower guide plates 122; driving roller 123; follower roller 124; means (unshown) for pressing the follower roller 124; oblique guide plate 127; neutralizing brush; solenoid 129 (refer to FIG. 7); and the like.

The upper face of the second gate plate 126 is usually in the horizontal position, whereby a recording sheet is positively transported on the horizontal path toward the horizontal right direction as indicated by an arrow. If the second gate plate 126 has been swung on an axle **126*c* as actuated by a solenoid 129 and is in the position shown by broken lines as in FIG. 6, a recording sheet P falls along the lower face of the second gate plate 126 and is transported toward a downward path 102** indicated by an arrow.

Toward the right of the second conveyance switching portion 120, and in the further downstream side of the horizontal path 100 is disposed a third conveyance switching portion 120.

The third conveyance switching portion 130 has constitution approximately same as that of the second conveyance switching portion, wherein a third gate plate 136 functions to selectively transport a recording sheet P either to the horizontal path 100 or to a downward path 103.

In the third conveyance switching portion 130, numeral 131 represents a photosensor; 122, upper and lower guide plates; 133, driving roller; 134, follower roller; 136, third gate plate; 137 oblique guide plate; 138, neutralizing brush; and 139, solenoid.

The second conveyance switching portion 120 is conveyance switching means disposed in the horizontal conveyance path 100, wherein the axle of the follower roller 124 is located at a distance L from the center of rotation of the driving roller 123, toward the upstream side in the conveyance path, relative to the nipping position between these rollers, and, at the same time, the driving roller 123 is pressed by presser means (unshown).

Likewise, the axle of the follower roller 134 in the third conveyance switching portion 130 is located in a position that is at a distance L, horizontally toward the upstream side in the conveyance path, relative to the axle of the driving roller 133.

Additionally, in the immediate downstream side of the above-mentioned follower roller 124 (134) is disposed the gate plate 126 (136).

By setting the distance L of the follower roller 124 (134) at 10 to 30% of the diameter of the driving roller 123 (133) or the follower roller 124 (134), whichever is thicker, conveyance is satisfactorily performed either in the horizontal (100) or oblique downward (102, 103) direction. If the diameter of the driving roller is 15 mm, and the diameter of the follower roller is 13 mm, the preferred distance is within a range of 1.5 to 4.5 mm. Assuming that L=3 mm, a tangential angle common to both rollers is approximately 12 degrees, whereby a recording sheet is transported downward in accordance with this angle from a nipping position.

Both the second conveyance switching portion 120 and the third conveyance switching portion 130 comprise rollers as described above, whereby the tangential angle at the nipping position between the driving roller 123 (133) and the follower roller 124 (134) and that is common to both rollers is downward, thereby a recording sheet P nipped at and then transported from the nipping position travels downward. If the gate plate 126 (136) is obliquely positioned as indicated by the broken lines in FIG. 6, a recording sheet P is readily and positively falls downward, thereby the sheet P travels along the downward path 102 (103) and is stored in a stacker described later. Even if a recording sheet P that has been curled in the fixing unit D is stored in the stacker via the second conveyance switching portion 120 or the third conveyance switching portion 130, the recording sheet P freely and smoothly falls without colliding against and disturbed by the guide plane of the gate plate 126 (136).

If the guide plane of the gate plate 126 (136) is in the horizontal position, the leading edge of a recording sheet P that has been transported from the nipping position between the two rollers reaches the downward oblique guide plate **126*a* (136*a*) of the gate plate 126 (136), and then, the recording sheet P travels upward, and and clears above the horizontal guide plane 126*b* (136*b*), and smoothly travels along the horizontal path 100. Once a recording sheet passing through a fourth conveyance portion 140, a send-out roller 151 feeds the recording sheet P into a U-turn path 104, thereby the sheet P travels to a stack tray 180**.

Figure 8:
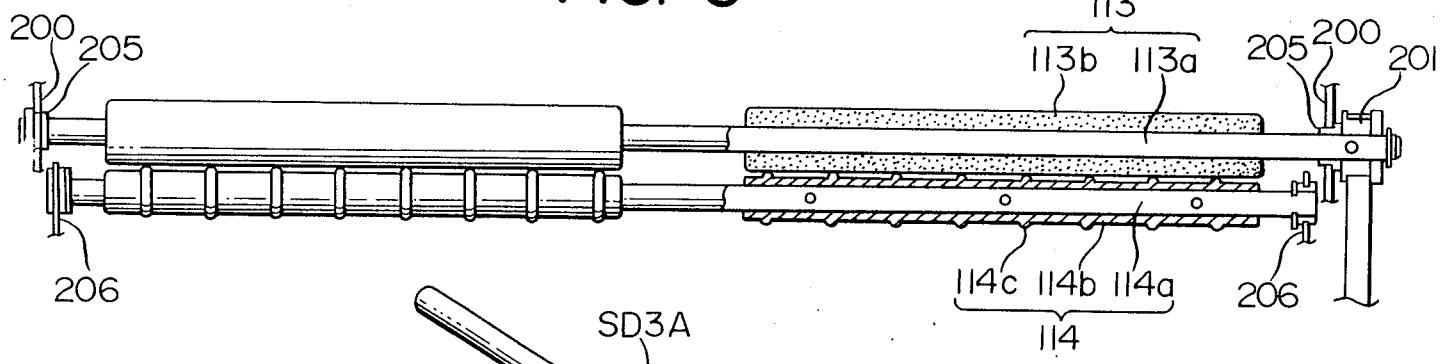
FIG. 8 illustrates cross-sections of a driving roller and a follower roller.

FIG. 8 shows details of the driving roller 113 and the follower roller 114, wherein in the right of the drawing is a side elevation, while in the left is a cross-sectional view.

The driving roller 113 comprises a rotary shaft **113*a*, and flexible roller portions 113*b* that constitute one entity together with the shaft 113*a*. To one end of the rotary shaft 113*a* is securely installed a toothed pulley 201, and at near both ends, the shaft 113*a* is rotatably supported by bearings 205 on both side plates 200**.

The flexible roller portions **113*b*** are composed of flexible members made, for example, of rather soft chloroprene of rubber hardness of 55 degrees or less.

The follower roller 114 comprises a rotary shaft **114*a*, and flexible roller portions 114*b* that constitute one entity together with the shaft 114*a*. The rotary shaft 114*a* is swingably supported by a support plate 200, and is pressed against the driving roller 113 by a resilient presser member 115. The roller portions 114*b* are independently a roller having, on its outer circumference, a plurality of protruded ribs 114*c*** (for example, width, 2 mm; height, 1 mm; roundness, 1 mm), and are made of formed resin such as of polypropylene, or polyacetal or the like.

As mentioned above, by pressing the driving roller 113 of a smaller rubber hardness against the follower roller 114 having a plurality of protruded ribs **114*c* by means of the presser member 115, the protruded ribs 114*c* are engaged with the flexible roller portions 113*b*. Both rollers so pressed together are allowed to rotated, thereby a recording sheet P is introduced into the so-formed nipping position. The recording sheets have possibly been curled in the fixing unit D, and, therefore, may fail to be transported to the stack tray 180 or may cause the sheets poorly aligned in the stack tray 180. Being nipped while passing through the nipping position, the recording sheet is corrugated with each groove running lengthwise by the operation of the protruded ribs 114*c* and the flexible roller portions 113*b*, thereby the curl is corrected, and the recording sheet P becomes stiffer, and the direction along which the recording sheet P is conveyed is stabler. As a result, every recording sheet P is positively transported to the stack tray 180**, free from paper jamming, or from misalignment.

As shown in FIG. 7, the driving and follower rollers 123 and 124 in the second conveyance switching portion 120, and the driving and follower rollers 133 and 134 in the third conveyance switching portion 130 are constituted in configuration and with materials respectively same as those in the first conveyance switching portion 110, wherein conveyance of each recording sheet P is stabler due to improved stiffness of each recording sheet P. Additionally, a number and pitches of protruded ribs in either the second or third conveyance switching portion are not necessarily same as those of the first conveyance switching portion 110.

Figure 9:
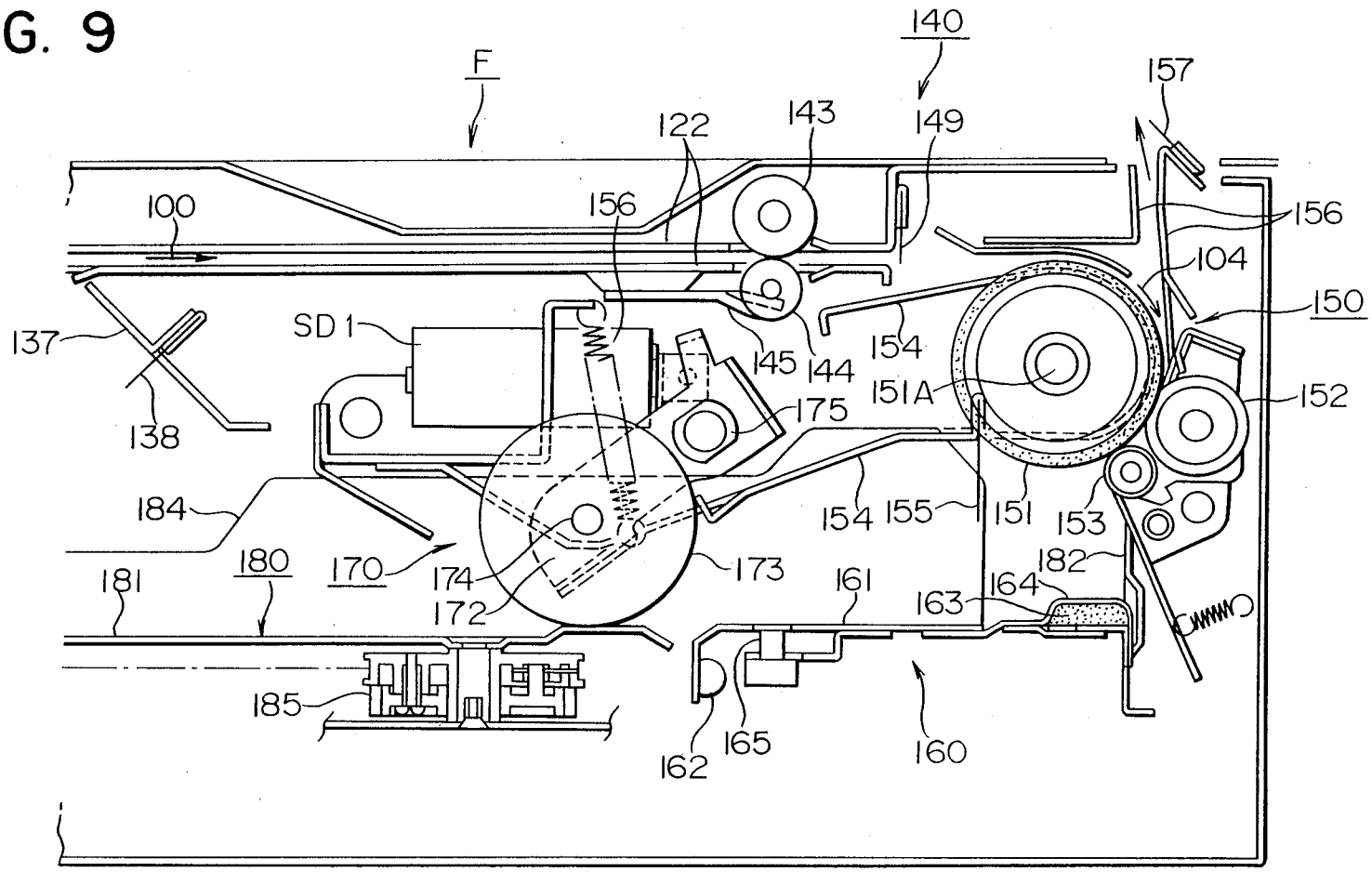

FIG. 9 is a cross-sectional view of the other end of the recording sheet conveyance apparatus F. In the further downstream side of the horizontal path 100 indicated by an arrow, there are disposed a fourth conveyance portion 140, driving roller 143, follower roller 144; presser member 145 for the follower roller; neutralizing brush 149; and the like.

Toward the right of the fourth conveyance portion 140 is disposed a secondary paper feed unit 150. The secondary paper feed unit 150 comprises a send-out roller 151, double-feeding prevention roller 152, auxiliary roller 153, guide plate 154, neutralizing brush 155, upper guide plate 156, neutralizing brush 157, lifter member 164, fulcrum 162, flexible pad 163, covering member 164, photosensor 165, and the like. The send-out roller 151 is a friction roller fixed on the central region of an axle 151A spanning between both side plates 200, and rotates forward.

The double-feeding prevention roller 152 has a built-in one-way clutch, and when the send-out roller 151 rotates clockwise, it rotates as a follower pressed onto the send-out roller 151 and feeds a recording sheet P into the stack side; when the send-out roller 151 rotates counterclockwise, the roller 152 does not serve as a follower and remains stationary, thereby recording sheets P, that are transported from the stack tray 180, are prevented from double-feeding, and the recording sheets are individually fed into an image forming portion B on the sheet-by-sheet basis. The auxiliary roller 153, being pressed with a spring onto the send-out roller 151, rotates as a follower.

This arrangement prevents, when a recording sheet P is fed into the stack side, the trailing edge of a recording sheet from being stagnant therein, and the arrangement enables the trailing edge to be positively released downward. Numeral 155 represents a neutralizing brush disposed beneath the guide plate 154.

Below the send-out roller 151 (refer to FIG. 9) is disposed recording sheet lifting means 160. Being disposed on one end of the stack portion 180, the lifting means 160 comprises the axle 162 that functions in conjunction with an unshown rotary lever, cam means, coil spring and the like; the lifter plate 161 secured onto the axle 162, and of which right end is usually capable of moving upward as energized by a spring, while the right end is capable of overcoming the force of the spring and of moving downward once the cam means is actuated; a flexible member 163, made for example of sponge rubber, and that is fixed on the upper face of the right end of the lifter plate 163; a friction sheet 164, made for example of artificial leather, and that covers the flexible member 163; and a photosensor 165 that detects the absence of a recording sheet P and is disposed on the opening of the lifter plate 161.

To the left of the send-out roller 151 (refer to FIG. 9) is disposed stopping means 170 against which a recording sheet P bumps. FIG. 10 is a perspective view of the stopping means 170.

Numeral 171 represents a rotary axle rotatably supported by both side plates 200, and having a gear G21 fixed on one end. The gear G21 is capable of rotating as energized by an intermediate gear G5 described later. Around the middle of the rotary axle 171 is secured a gear G23 that engages with a gear G24 supported on a frame 172. Being mounted commonly on a shaft 174, the gear G24 and a bumper roller 173 constitute one entity that is supported by bearings on the frame 172.

The rotary axle 171 is engaged with the bearings 175 on the frame 172, wherein the frame 172 is disposed rotatable relative to the rotary shaft 171.

On one end, to the left, of the frame 172, there is a spring 176 that always exerts a force to the bumper roller 173 so that the roller 173 is constantly energized upward. One end 172A of the frame 172 is connected to a plunger SD3A on a solenoid SD3, whereby when the plunger SD3A exerts an attractive force, the frame 172 overcomes the tension of the spring 176 and swings on the rotary axle 171, and shifts the bumper roller 173 downward.

In the lower stage of the recording sheet conveyance apparatus F is formed the stack portion 180. The stack portion 180 comprises a recording sheet table 181; fixed, recording sheet leading edge stopper 182; movable, rear guide member 183 along which the trailing edges of recording sheets are aligned with each other; movable side guide plates 184 that, when coming into contact with the side edges of recording sheets P, are capable of aligning recording sheets P; rear guide plate driving mechanism that, being driven by a motor with a clutch that is disposed on the bottom of the recording sheet table 181, is capable of moving or stopping the above-mentioned rear guide member 183 to or in a specific position; side guide driving mechanism (unshown) that moves the above-mentioned side guide plates 184 in the cross direction relative to recording sheets P; and the like.

Figure 11:
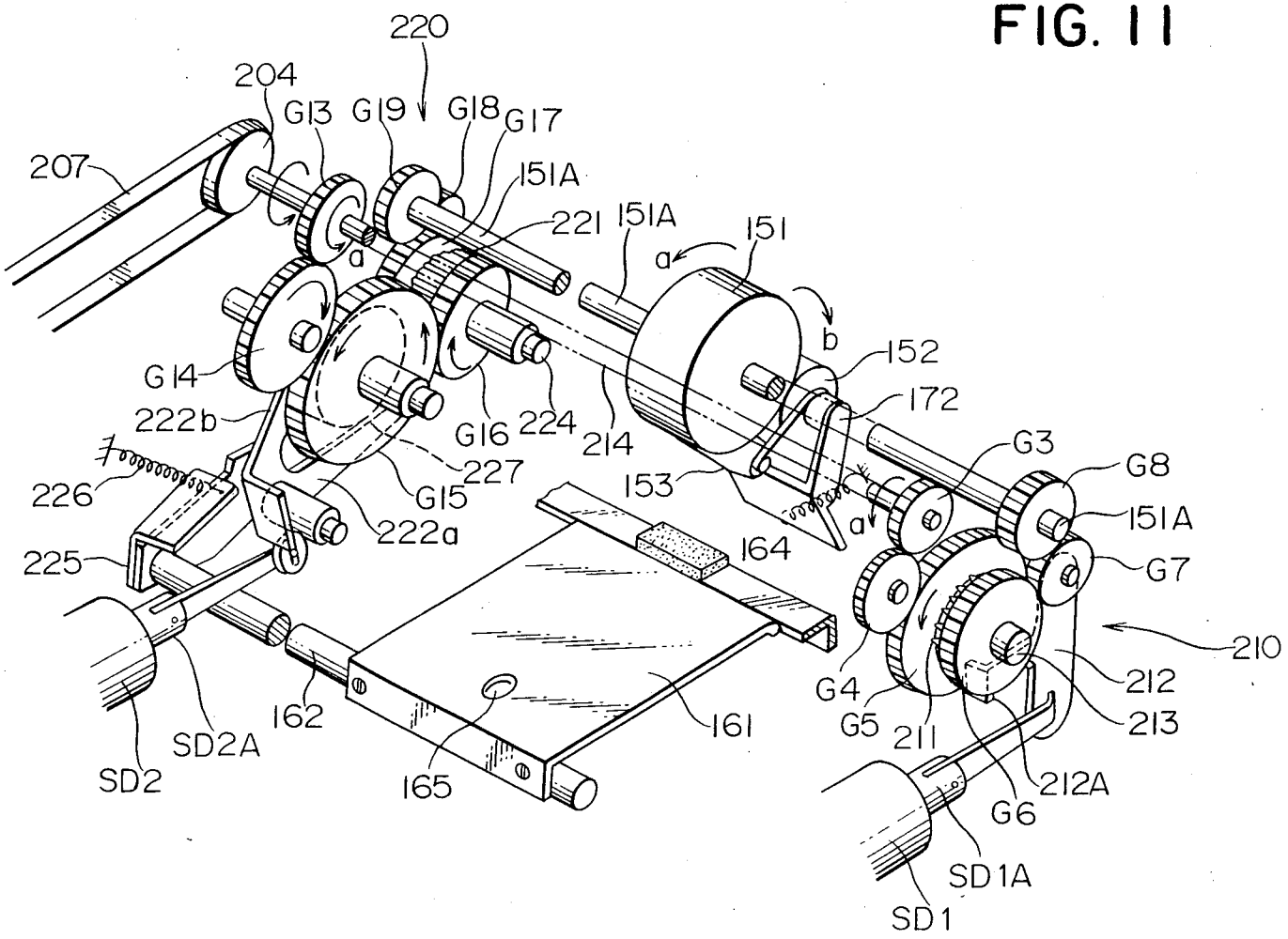
Figure 12:
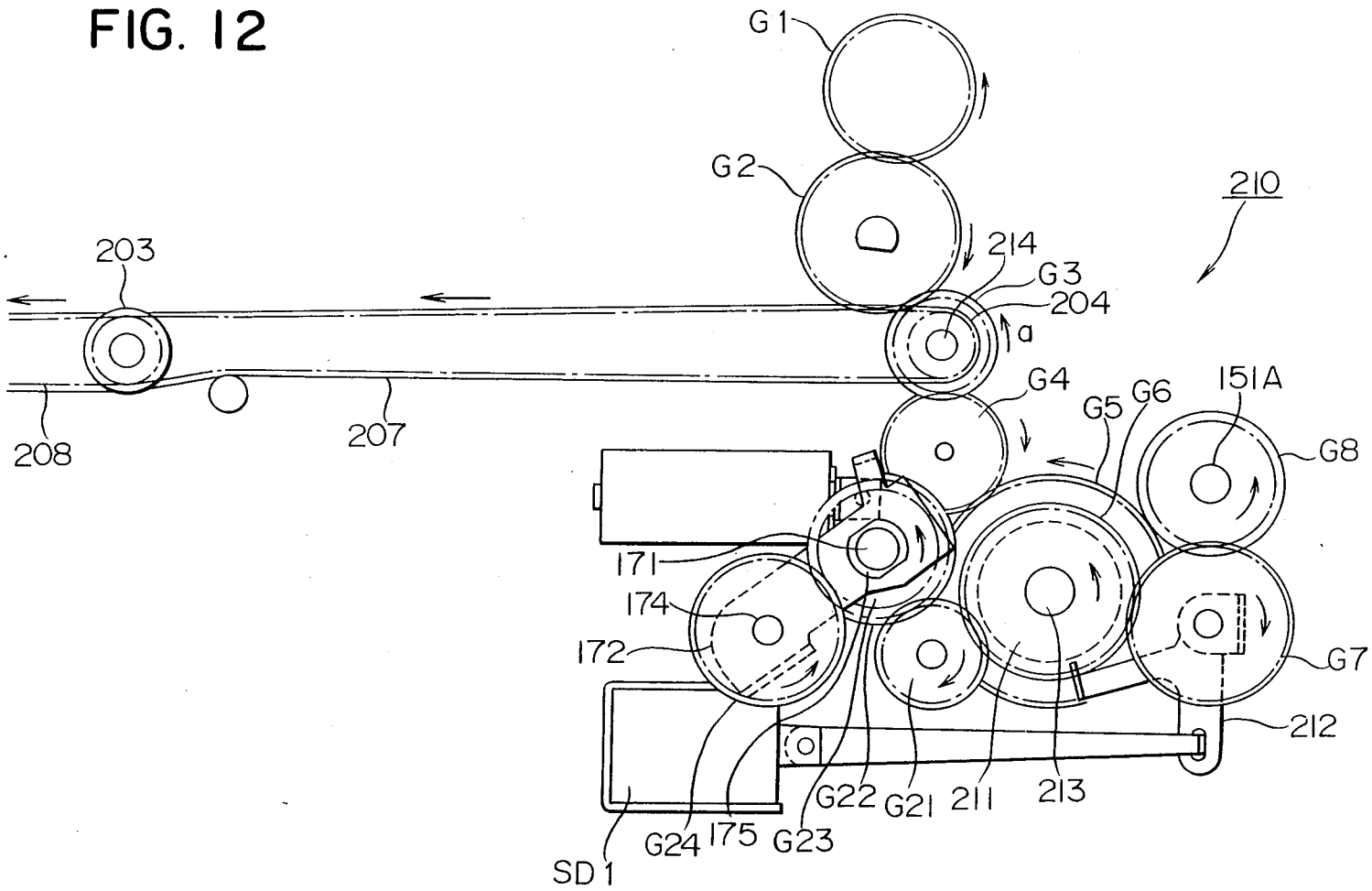
FIG. 12 illustrates side views of a series of gears.
Figure 15:
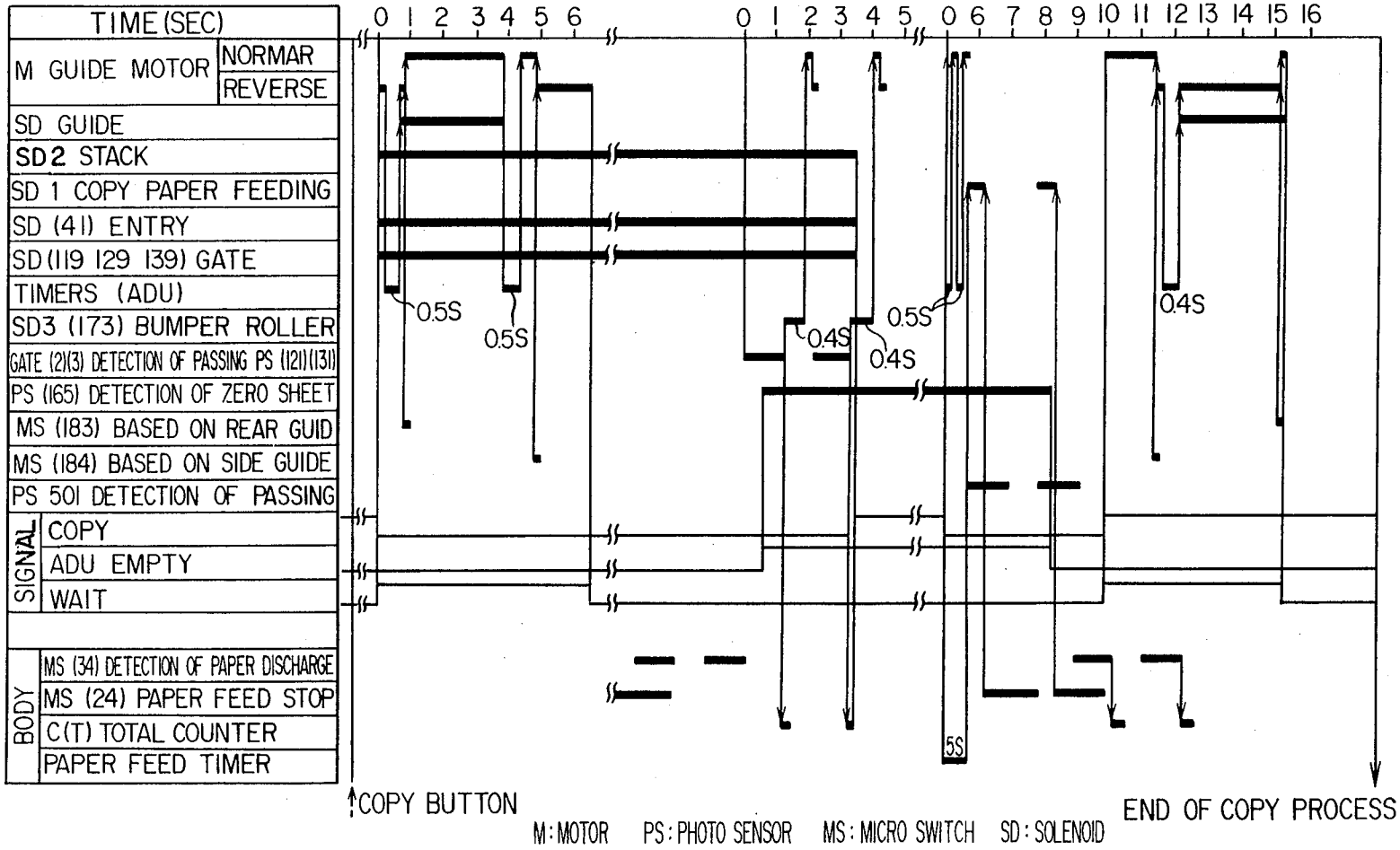
FIG. 15 is a timing chart.

Next, the driving mechanism of the recording sheet conveyance apparatus F is hereunder described referring to the perspective view in FIG. 11, a side view in FIG. 12, and a timing chart in FIG. 15.

The motive power on the image recording system (copying apparatus) is transmitted via gears G1 and G2 to a gear G3 on the conveyance apparatus F. A toothed pulley 204 on the axle same as that of the gear G3 drives a toothed pulley 202 via a toothed belt 207, and, at the same time, rotates a toothed pulley 201 via a toothed belt 209, whereby the driving rollers 133, 123, and 113 are driven synchronously.

The send-out roller 151 in the secondary paper feed unit 150 comprises an axle 151A, to one end of which is disposed a gear array 210, and to the other end of which is disposed a gear array 220, whereby the send-out roller can be selectively rotated either forward or backward. More specifically, the gear array 210 comprises a gear G3 that, in conjunction with the previously mentioned gears G1 and G2, rotates in the arrow a direction (counterclockwise); a gear G4 engaged with the gear G3; a gear G5 engaged with the gear G4; a gear G6 that, being disposed coaxially with the gear G5, drives the gear G5 via a clutch 211 that is connected and disconnected by a solenoid SD1. Whereby, when the gear G6 rotates in conjunction with the gear G5 by operation of the clutch 211, the rotation is transmitted, via an intermediate gear G7, then, via a gear G8 fixed on one end of the axle 151A, to the send-out roller 151, thereby the roller 151 rotates in the arrow b direction. The above-mentioned clutch 211 disengages the gear G6 from the axle 213 of the gear G5 when the solenoid SD1 is turned ON, i.e. when a plunger SD1A is withdrawn, and, as a result, when an end tip 212A of a lever 212 is engaged with a ratch on the outer circumference of the clutch 211. On the other hand, when the solenoid SD1 is turned OFF, the gear G6 is engaged with the axle 213.

The other gear array 220 comprises a gear G14 engaged with a gear G13 that is secured on the other end of the axle 214 of the gear G3 that rotates in the arrow a direction; a gear G15 engaged with the gear G14; a gear G16 engaged with the gear G15; a gear G17 that, being disposed coaxially with the gear G16, drives the gear G16 via a clutch 221 that is connected and disconnected by a solenoid SD2. Whereby, when the gear G17 rotates in conjunction with the gear G16 by operation of the clutch 221, the rotation is transmitted, via an intermediate gear G18, then, via a gear G19 fixed on the other end of the axle 151A, to the send-out roller 151, thereby the roller 151 rotates in the arrow a direction.

When the solenoid SD2 is turned ON, i.e. when a plunger SA2A is withdrawn to swing clockwise a Y-shaped lever 222, the Y-shaped lever 222 overcomes the force of a spring (unshown) and one end of the Y-shaped lever 222 is lifted upward and is engaged with a ratch on the outer circumference of the clutch 221, whereby the above-mentioned clutch 221 disengages the gear G17 from the axle 324 of the gear G16.

When the solenoid SD2 is turned OFF, and the Y-shaped lever 222 is swung counterclockwise by the force of the spring (unshown), the lever is disengaged from the ratch, thereby the gear G17 is engaged with the axle 224 of the gear G16. In other words, the send-out roller 151 rotates in the arrow a direction based on the gear array 210, i.e. if the solenoid SD1 is in OFF status; the roller 151 rotates in the arrow b direction based on the gear array 220, i.e. if the solenoid SD2 is in OFF status.

In the case of the rotation in the arrow a direction, the solenoid SD2 of the gear array 220 is in ON status, and the gear G17 is disengaged; and in the case of the rotation in the arrow b direction, the solenoid SD2 of the gear array 210 is in ON status, and the gear G6 is disengaged.

As mentioned above, when the Y-shaped lever 222 of the gear array 220 swings downward (clockwise) as energized by the active (turned ON) solenoid SD2, the tip of a lower lever portion 222A of the Y-shaped lever 222 functions so that a rotary lever 225 hitherto held in a depressed position by a rotator 227 having a built-in clutch and disposed coaxially with the gear G15 is allowed to rotate counterclockwise, thereby the axle 162 of the lever 225 is rotated in the same direction. To the axle 162 of the rotary lever 225 is, as shown in FIG. 9, secured a lifter plate 161, and, accordingly, the lifter plate 161 moves upward, pressing a recording sheet P against the send-out roller 151.

When the above-mentioned Y-shaped lever 222 is actuated upward by the force of a spring once a solenoid SD2 is turned OFF, an upper lever portion 222*b* of the lever 222 is disengaged from the rotator 227, thereby the rotator 227 overcomes the force of the spring 226 and depresses the rotary lever 225, and, at the same time, depresses the lifter plate 161.

As shown in FIGS. 12 and 10, the intermediate gear G5 drives a gear 22 via an idler gear G21. A gear G23 coaxial with the gear 22 drives a gear G24 counterclockwise and turns the bumper roller 173 to the same direction. The above-mentioned bumper roller 173 is composed of, for example, chloroprene sponge of rubber hardness of 25+5 degree. A solenoid SD3 swings the bumper roller 173 upward and downward.

Figure 13A:
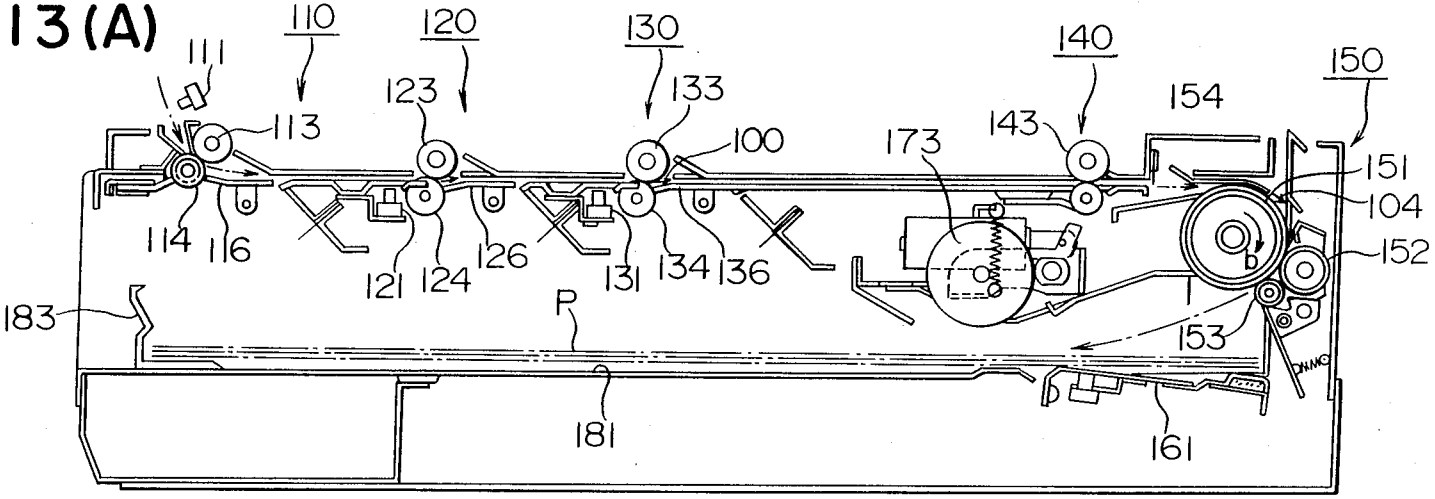
FIGS 13*a* and 13*b* illustrate cross-sections of a recording sheet conveyance path in the double-side copy (ADU) mode.
Figure 13B:
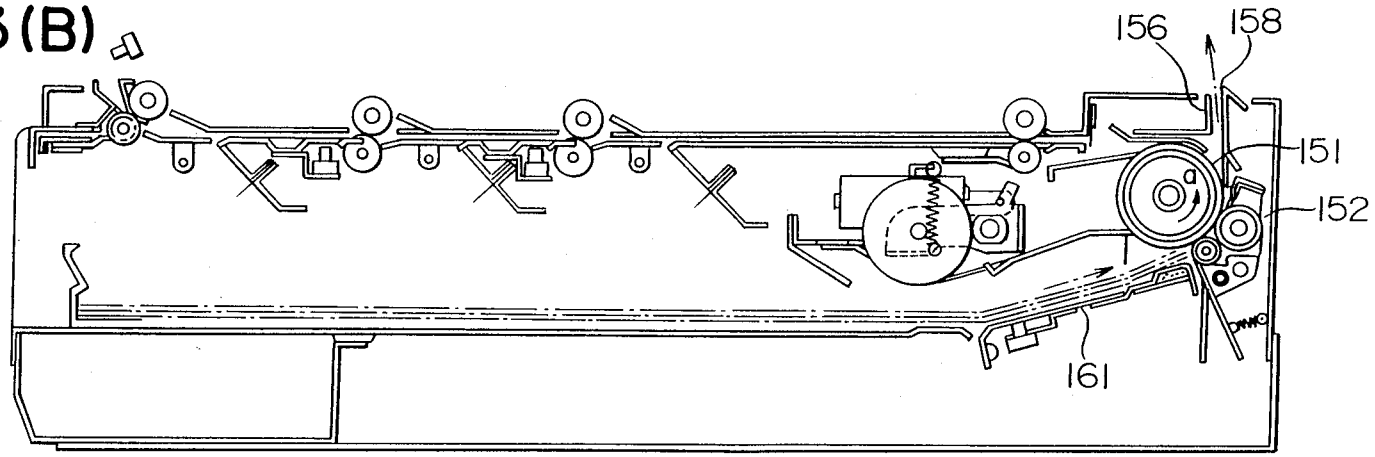

FIG. 13 is a cross-sectional view where a recording sheet P is transported in accordance with double-side copy mode (ADU), wherein FIG. 13(A) shows a status where a recording sheet P is introduced; FIG. 13(B) shows a status where a recording sheet is delivered outside.

When mode 1 or mode 2 in two-side copy conveyance mode (ADU) is designated with the copy mode selection key 55 on the operation panel 50, the gate plates 116, 126, and 136 respectively in the first (110), second (120), and third (130) conveyance switching portions are held horizontally, wherein the bumper roller 173 is held in the upper position, and the lifter plate being in the lowered position.

Under such a circumstance, a recording sheet P having been transported from the delivery/reversing portion E downward to the recording sheet conveyance apparatus F is positively transported via the first conveyance switching portion 110, second conveyance switching portion 120, third conveyance switching portion 130, and fourth conveyance switching portion 140, and further allowed to travel along the guide plates 154. At this point, the send-out roller 151 is rotating in the arrow b direction by the operation (solenoid SD2 is in OFF status) of the gear array 220, and, accordingly, the recording sheet P is transported by the send-out roller 151, and allowed to slide down onto the sheet table 181 on the stack tray 180 and is stored therein.

In this course, the double-feeding prevention roller 152 pressing upon the send-out roller 151 idly rotates. Additionally, since the auxiliary roller 153 is pressed upon the send-out roller 151 in the downstream side of conveyance, a recording sheet P is positively fed until the leading edge reaches the rear guide plate 183 located far end of the stack tray 180. The position of the rear guide plate 183 can be automatically adjusted based on the size of a recording sheet P.

Next, once a predetermined number of recording sheets P respectively bearing a recorded image on one face are stored in the stack tray 180 (i.e. after the completion of one-side copying), the solenoid SD2 of the gear array 220 is turned ON, thereby, as mentioned previously, the solenoid SD2 lifts the lifter plate 161, and the uppermost recording sheet P among those positioned on the lifter plate 161 is pressed against the lower position of the paper supply roller 151. And, after a marginal delay, the solenoid SD1 of the gear array 210 is turned OFF, allowing the send-out roller 151 to rotate in the arrow a direction.

More specifically, the send-out roller 151 starts only after a recording sheet P in the stack tray 180 is pressed by the lifter plate 161. Accordingly, recording sheets P are sent out by friction with the send-out roller 151, and separated into individual sheets by the double-feeding prevention roller 152, thereby individual sheets travel through an opening between the guide plates 158 and reach the recording sheet supply path of the primary paper feed means and are refed into the image forming portion B, thereby an image is formed on the other face of the individual recording sheets P, thus two-side recording is complete.

Figure 14A:
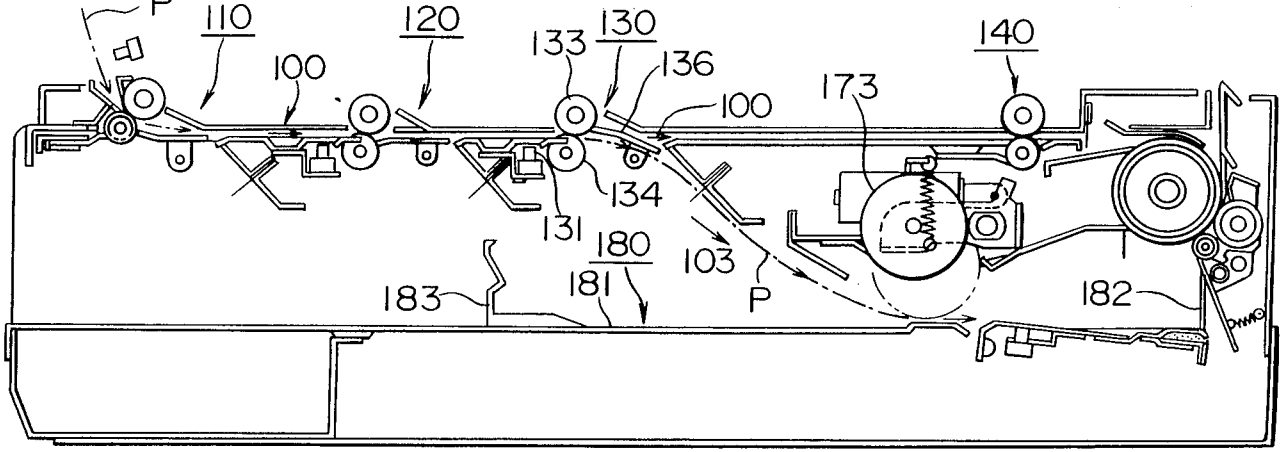
FIGS. 14*a* and 14*b* illustrate cross-sections of a recording sheet conveyance path in the composite copy (RADU) mode.
Figure 14B:
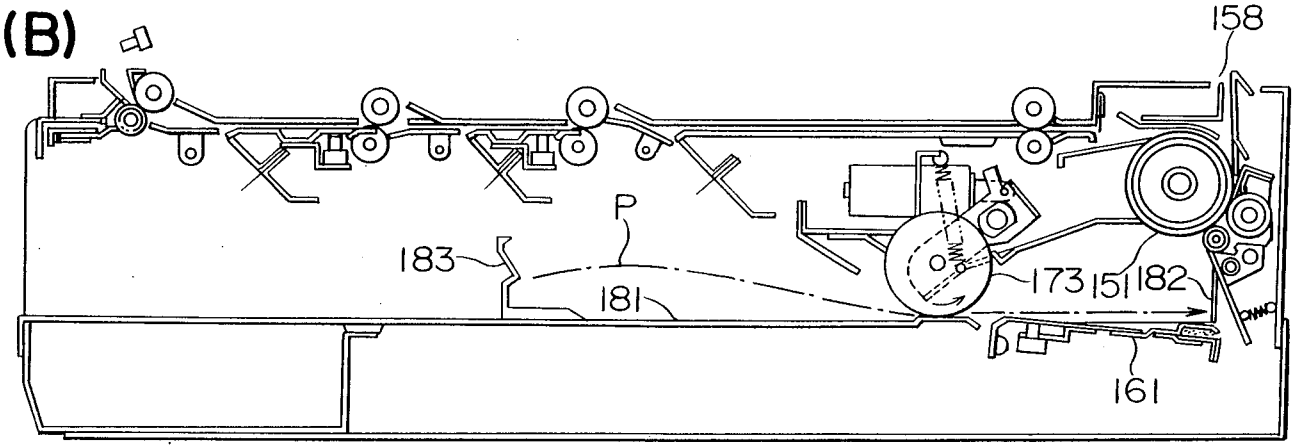

FIG. 14 is a cross-sectional view where a recording sheet P is transported in a composite copy mode (RADU), wherein FIG. 14(A) illustrates the case where a recording sheet P is introduced into the stack portion; FIG. 14(B) illustrates the case where a recording sheet P is transported from the stack portion to the image forming portion.

Using the multiple copy selection key 59 on the operation panel 50, one of modes (A), (B), and (C) shown in FIG. 5 is designated.

Next, the size and orientation of recording sheets P being subjected to image-recording are entered with the recording sheet size selection key 54 on the operation panel 50, thereby one of the first (116), second (126), and third (136) gate plates is selected, and forms a downward path as actuated by a solenoid.

Table 1 shows interrelation among the size of a recording sheet P and orientation of feeding, a corresponding duration of actuation of the bumper roller, and a selected gate plate.

FIG. 14 illustrates the condition where the third gate plate 136 is obliquely positioned, thereby the downward path 103 has been formed.

Under this condition, a recording sheet P travels from the delivery/reversion portion E, via the first conveyance switching portion 110, reaches the horizontal path 100, and further travels along the second conveyance switching portion 120 and reaches the third conveyance switching portion 130.

At this point, the third gate plate 136 is, as mentioned previously, held in an oblique position, thereby the recording sheet P is diverted to the obliquely downward direction along the lower guide face of the third gate plate 136, and the recording sheet P follows the trajectory of the downward path 103, and slides along the recording sheet table 181 on the stack tray 180, and reaches the stopper 182.

TABLE 1

| Recording sheet size | | Feeding | Actuation | Gate used | Downward |
|---|---|---|---|---|---|
| size name | A × B (mm) | direction | time (m sec) | No. | path |
| | | JIS (Japanese Industrial Standard) | | | |
| A3 (width) | 297 × 420 | → | 330 | (116) 1st gate | 101 |
| B4 (width) | 257 × 364 | → | 780 | 1st gate | 101 |
| A4 (width) | 210 × 297 | → | 300 | 2nd gate | 102 |
| B5 (width) | 182 × 257 | → | 650 | 2nd gate | 102 |
| A4 (length) | 297 × 210 | → | 430 | (136) 3rd gate | 103 |
| B5 (length) | 257 × 182 | → | 600 | (126) 3rd gate | 103 |
| | | US Standard | | | |
| Twice as large as letter size (width) | 279 × 432 (11" × 17") | → | 300 | 1st gate | 101 |
| Legal size (width) | 216 × 356 (8.5" × 14") | → | 800 | 1st gate | 101 |
| Letter size (width) | 216 × 279 (8.5" × 11") | → | 330 | 2nd gate | 102 |
| Letter size (length) | 279 × 216 (11" × 8.5") | → | 400 | 3nd gate | 103 |
| Government size (width) | 203 × 268 (8" × 10.5") | → | 600 | 2nd gate | 102 |

Once the passage of the trailing edge of a recording sheet P is detected by the photosensor 131, and after a predetermined number of pulses have been counted, a signal is fed into the solenoid SD3. Accordingly, the rotating bumper roller 173 is lowered and pressed upon around the leading edge of the recording sheet P. At this point, the trailing edge of the recording sheet P has already passed through the nipping position formed between the driving roller 133 and the follower roller 134.

As long as a signal is fed into the solenoid SD3 for a predetermined duration specified in Table 1, the bumper roller 173 keeps rotating, and positively transports the recording sheet P, thereby the sheet P comes into contact with the stopper 182.

FIG. 14(B) illustrates the condition where a recording sheet P is transported by the above-mentioned bumper roller 173.

When the leading edge of a recording sheet P reaches the stopper 182 and comes to halt, the pressing force of the bumper roller 173 is cancelled by the solenoid to which a signal has been fed, thereby the bumper roller 173 is lifted well away from the sheet P.

The side guide plates 184, that has been in a position well away from the sheet P, swiftly approach the recording sheet P now stationary, and beat both side edges of a recording sheet P for alignment of side edges, and then, immediately returns to the position well away from the sheet P.

Next, a second recording sheet P travels likewise via the horizontal path 100, and the third gate plate 136, and along the downward path 103, and then, the sheet P is transported by the tractive force of the bumper roller 173 to the stopper face 186, thereby the sheet P is loaded onto the table 181 of the stack tray 180, and both sides edges of the sheet are aligned.

Once all the recording sheets P undergone one-side recording have been loaded on the table 181, the rear guide plate 184 shifts to the stopper side by the driving mechanism 185, thereby the leading and trailing edges of recording sheets are aligned with each other.

Incidentally, the recording face of individual recording sheets P on the table 181 is positioned downward.

Figure 16:
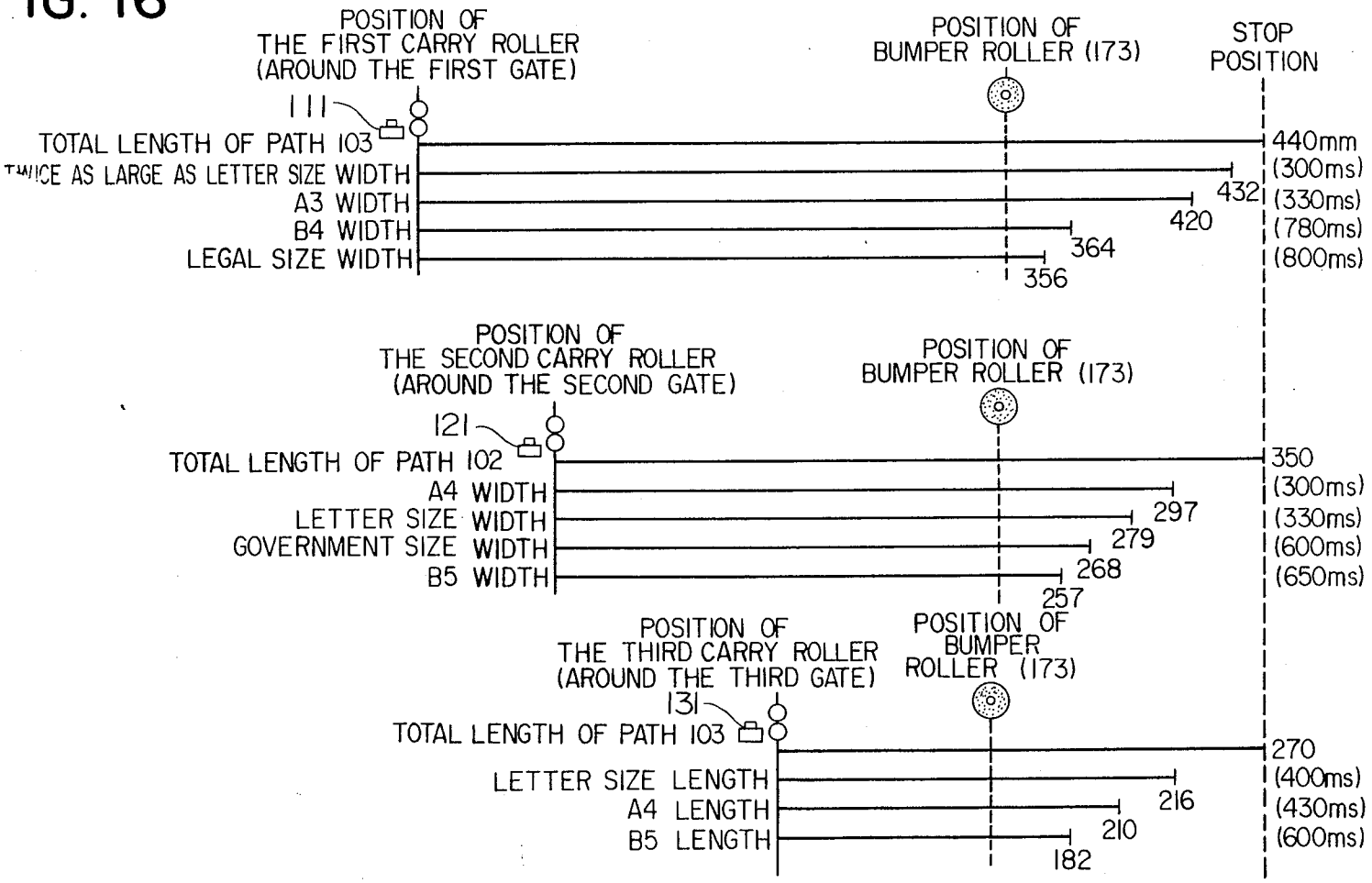
FIG. 16 illustrates line drawings explaining operation of a bumper roller.

FIG. 16 includes explanatory diagrams, each schematically show the correlation between the size (length) of a recording sheet P and the length of each conveyance path (101, 102, or 103). The actuation duration of the bumper roller 173 is dependent upon a difference between the total length of each path and the length of a recording sheet.

Figure 17:
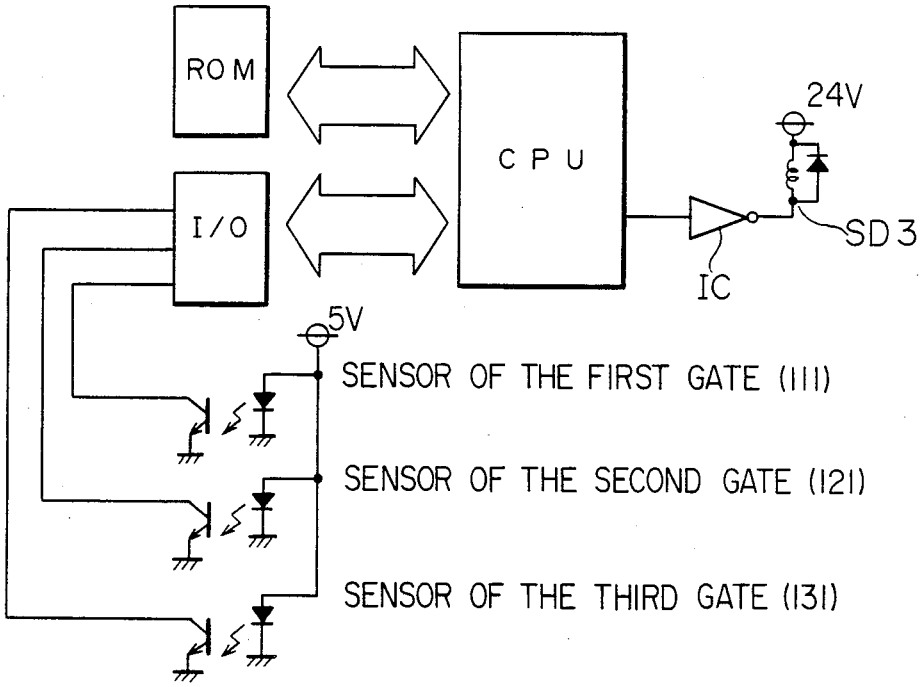
FIG. 17 is a block diagram of a system controlling the positioning roller.

FIG. 17 is a block diagram of control circuitry for controlling the solenoid that moves the bumper roller 173 either upward or downward. A photosensor 111 of the first gate detects the passage of a recording sheet P, and feds a signal into an input/output (I/O) port, thereby the signal is processed by a microprocessor (CPU), and a driver IC is energized either to turn ON or OFF the solenoid SD3. "ROM" stands for a read-only memory that assigns address data to the microprocessor (CPU).

Next, after a predetermined number of recording sheets each bearing a recorded image on one face are stored in the stack tray 180 (that is, after the completion of one-side copy process), the lifter plate 161 is, as previously mentioned, lifted upward, thereby the recording sheets P are sent out as pressed by the send-out roller 151, and separated by the double-feeding prevention roller 152 into individual sheets P, and each sheet P is transported upward through the opening 158, thereby by a timing roller 24 in the primary paper feed means, each sheet is introduced into the recording sheet conveyance path, and refed into the image forming portion B, thereby an image is formed on the face of each recording sheet P, that is the face same as already being a recorded image, thus multiple/composite recording is completed.

The two-color trimming/masking copying according to the (e) and (f) modes in FIG. 4, as well as one-color compositie copying and two-color composite copying in FIG. 5 are performed based on the above-mentioned recording sheet conveyance according to the RADU mode.

The above description relates to a conveyance path where a recording sheet P travels along the third conveyance switching portion 130, and via the downward path 103, and is stored in the stack tray 180. However, it is also possible that a recording sheet traveling from the first (110) or second (120) conveyance switching portion to the downward path 101 or 102 can be subjected either to trimming/masking or composite copying by the similar operation.

As described above, the recording sheet stacking apparatus, of the invention, in an image recording system, comprises a roller which is movable upward and downward and rotates as pressed onto a recording sheet being transported to a stack tray in the recording sheet conveyance apparatus, wherein the actuation duration during which the roller rotated as pressed onto a recording sheet is varied depending on the size of a recording sheet being transported. Accordingly, the recording sheet stacking apparatus is highly advantageous in that various sizes of recording sheets being stored in the stack tray are correctly and positively stored in the stack tray, and the leading edges of the recording sheets are aligned with a specific stop position, thereby when the recording sheets are re-sent out of the stack tray, each recording sheet is positively engaged with a friction member, and positively refed into an image forming portion.

What is claimed is:

1. A sheet stacking apparatus for use in an image recording system in which a feeding means feeds recording sheets to an image forming means to record a first image on a first side of said sheets, a conveying means conveys the recording sheets with the first image recorded thereon to a sheet stacking apparatus, and said feeding means delivers said recording sheets from said sheet stacking apparatus to said image forming means to form a second image on a second side of said sheets, said sheet stacking apparatus comprising;

a sheet stacking means having a tray for receiving said recording sheets thereon;

a stopper provided on said tray to stop said recording sheets and align the leading edges of said recording sheets;

a bumper roller which is capable of retractably shifting to a downward position to be in pressure contact with said recording sheets and transport said recording sheets by rotary motion of said roller so that the leading edges thereof reaches said stopper and, an upward position to detach from said recording sheets when said leading edges reach said stopper;

a sensor located upstream from said roller for detecting the passage of said recording sheets through said conveying means and;

a control means for controlling the position of said roller in response to a signal from said sensor so that said roller is shifted downward onto the recording sheets to be aligned when said sheets enter said tray.

* * * * *